US008800076B2

(12) United States Patent
Ophaug et al.

(10) Patent No.: US 8,800,076 B2
(45) Date of Patent: Aug. 12, 2014

(54) SPRING RETRACTABLE TRANSFER BELT APPARATUS

(76) Inventors: Bryan Jeffrey Ophaug, Minneapolis, MN (US); Kristen Joanne Erickson, Apple Valley, MN (US)

( * ) Notice: Subject to any disclaimer, the term of this patent is extended or adjusted under 35 U.S.C. 154(b) by 178 days.

(21) Appl. No.: 12/879,105

(22) Filed: Sep. 10, 2010

(65) Prior Publication Data

US 2012/0011649 A1 Jan. 19, 2012

Related U.S. Application Data

(60) Provisional application No. 61/365,652, filed on Jul. 19, 2010, provisional application No. 61/369,216, filed on Jul. 30, 2010.

(51) Int. Cl.
*A61G 7/10* (2006.01)

(52) U.S. Cl.
USPC ..... 5/81.1 T; 5/89.1; 2/338; 2/339

(58) Field of Classification Search
USPC ..... 5/81.1 T, 89.1; 33/754–755, 732; 2/338–339
See application file for complete search history.

(56) References Cited

U.S. PATENT DOCUMENTS

| | | | | |
|---|---|---|---|---|
| 2,709,393 | A * | 5/1955 | Anderson | 359/519 |
| 5,381,318 | A * | 1/1995 | Fang | 362/108 |
| 6,311,346 | B1 * | 11/2001 | Goldman | 5/81.1 T |
| 7,617,615 | B1 * | 11/2009 | Martorell et al. | 33/759 |

* cited by examiner

*Primary Examiner* — Fredrick Conley
(74) *Attorney, Agent, or Firm* — Vidas, Arrett & Steinkraus P.A.

(57) ABSTRACT

A transfer belt for assisting in moving patients includes a transfer belt, a mechanism to retract the belt into a compact unit and a mechanism to fix the belt in a fixed loop around a patient at the size desired.

4 Claims, 12 Drawing Sheets

SPRING RETRACTABLE TRANSFER BELT APPARATUS

CROSS-REFERENCE TO RELATED APPLICATIONS

This is a Rule 1.53(c) (3) conversion of provisional patent application Ser. Nos. 61/369,216 filed Jul. 30, 2010 and 61/365,652 filed Jul. 19, 2010.

STATEMENT REGARDING FEDERALLY SPONSORED RESEARCH OR DEVELOPMENT

Not Applicable.

BACKGROUND OF THE INVENTION

This invention relates to transfer belts, also known as gait belts, which are secured around the waist of medical patients having mobility difficulties. The transfer belt allows a medical assistant, nurse, physical therapist, nursing assistant or other careprovider to assist the movement of the patient by providing a belt which can be grasped by the care provider.

When not in use, the transfer belt is wound up into a roll and either put into the care provider's pocket or set on the table or else worn around the waist or across the chest of a care provider. The care provider has to take off the transfer belt or unwind the transfer belt when they want to use it. After they use it they have to wrap it around and buckle it to themselves or else wind it up and put it into their pocket or set it on the counter. U.S. Pat. No. 6,311,346 shows a transfer belt including side pads.

When the care provider wears the belt around their waist or chest, the belt comes into contact with other patients and surfaces. This is an infection control problem. Accordingly, there is a need for a transfer belt that can be retractable and user friendly. Also, there is a need for a retractable belt that is stored inside an external housing unit which acts as a barrier to contact with patients and germs when not in use. There is a further need for a belt which provides these benefits which is inexpensive in cost.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

The invention provides a transfer belt that is retractable. The spring retractable nature of the transfer belt makes it easier to carry the belt and easier to wind and unwind. The retractable belt increases the safety of the belt because when the belt is retracted into the housing unit it decreases the contact the belt has with other people and surfaces, thus decreasing contact with infectious agents or germs. According to this invention there is provided a transfer/gait belt comprising: a casing which acts as an outer shell or housing for the belt; a dowel mounted for rotation within the casing; a transfer belt wrapped around the dowel and adapted to be withdrawn from the casing; a spring adapted to rotate the dowel to retract the belt after it has been at least partly withdrawn from the casing. The belt may or may not have holes in it.

The transfer belt will therefore have a housing into which a transfer belt may be retracted by a spring. The transfer belt itself has a mechanism for forming a discrete loop that can be fastened around a patient to fit as desired.

BRIEF DESCRIPTION OF THE DRAWINGS

A detailed description of the invention is hereafter described with specific reference being made to the drawings in which:

FIG. 14B shows the lock mechanism of FIG. 15A in which the belt is locked;

DETAILED DESCRIPTION OF THE INVENTION

Figure 1:
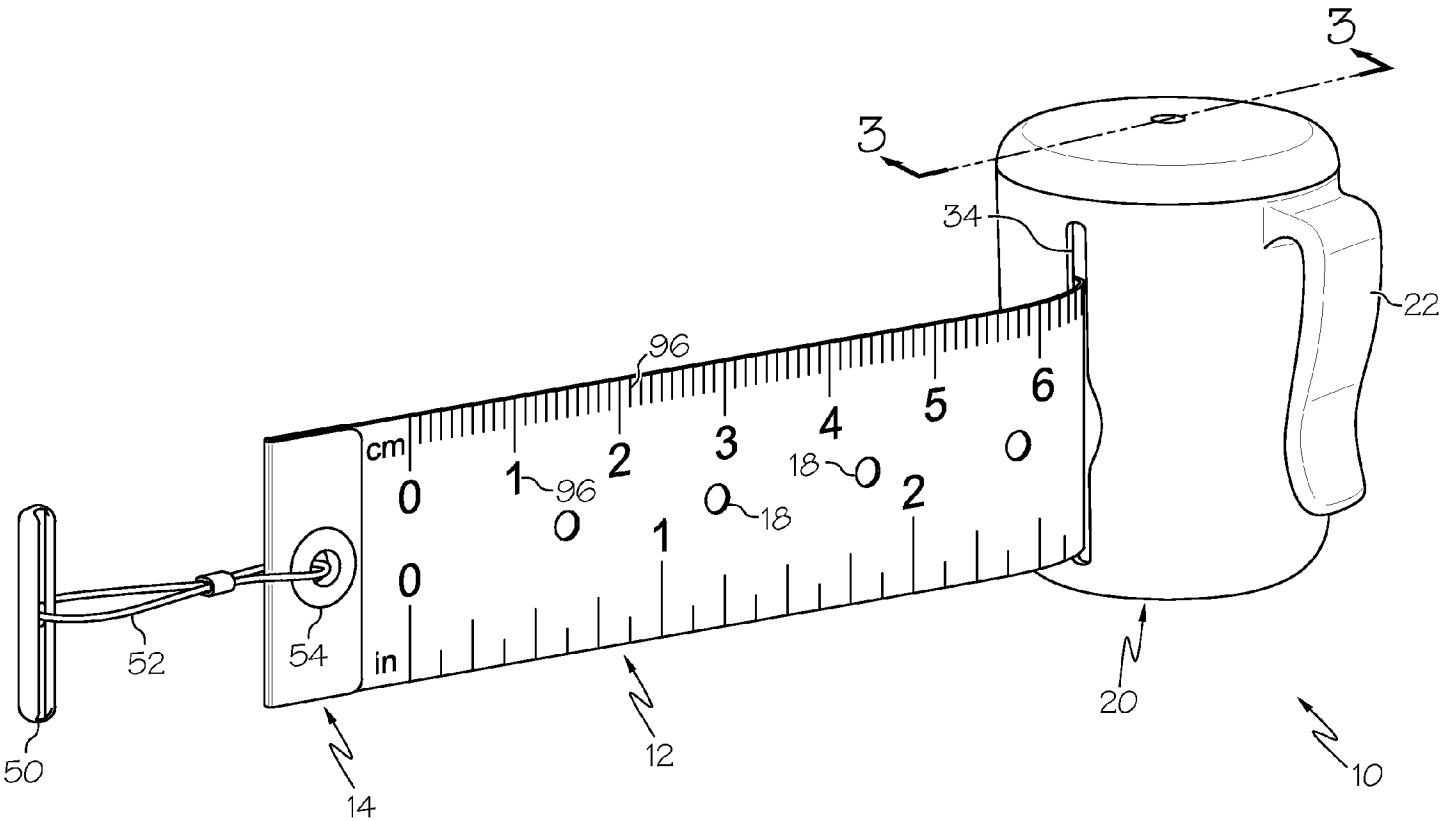
FIG. 1 is a perspective view of a retractable transfer belt of the invention.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

As shown in the Figures, the retractable transfer belt apparatus 10 includes a belt 12 with a free end 14 and an attached end 16, which may or may not have a plurality of spaced openings or holes 18 located along the belt 12.

Figure 2:
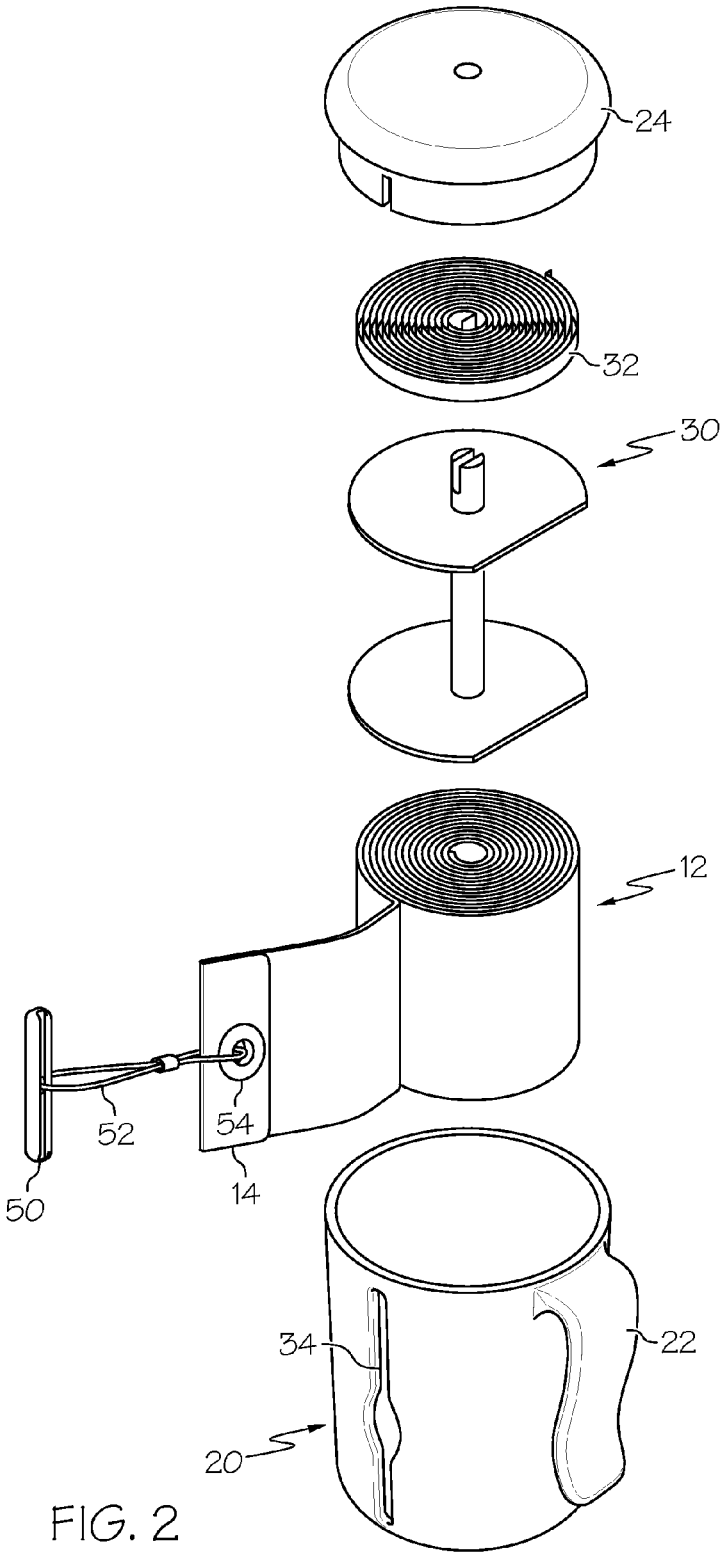
FIG. 2 is an exploded view of the transfer belt of FIG. 1.
Figure 3:
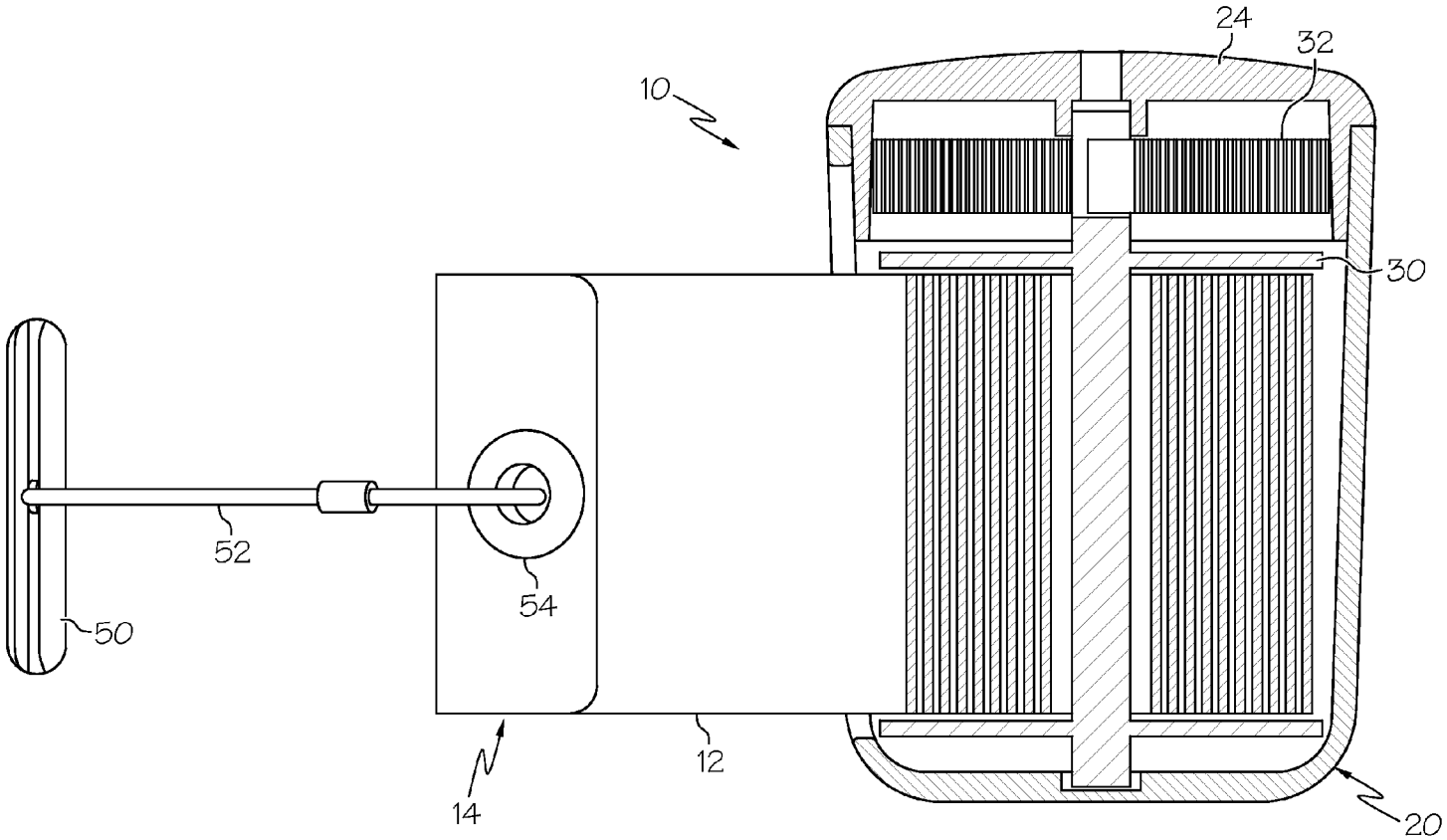
FIG. 3 is a cross-section through line 3-3 of FIG. 1.
Figure 4:
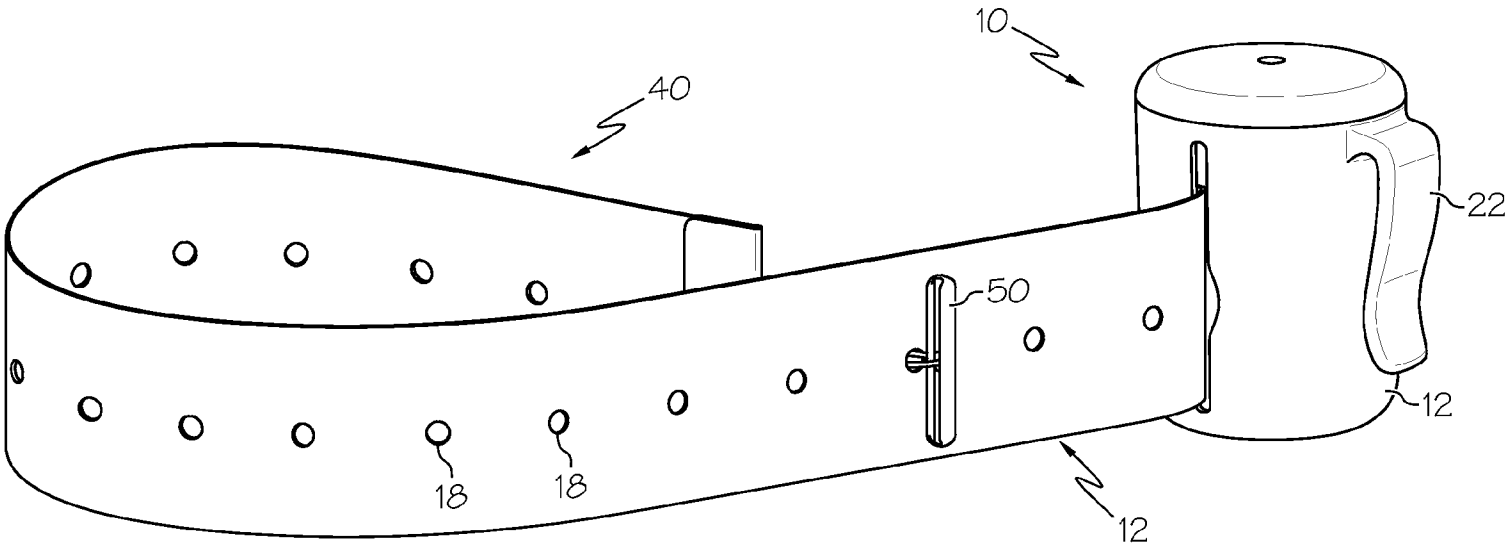
FIG. 4 is a perspective view showing the belt extended and secured to form a loop.
Figure 5:
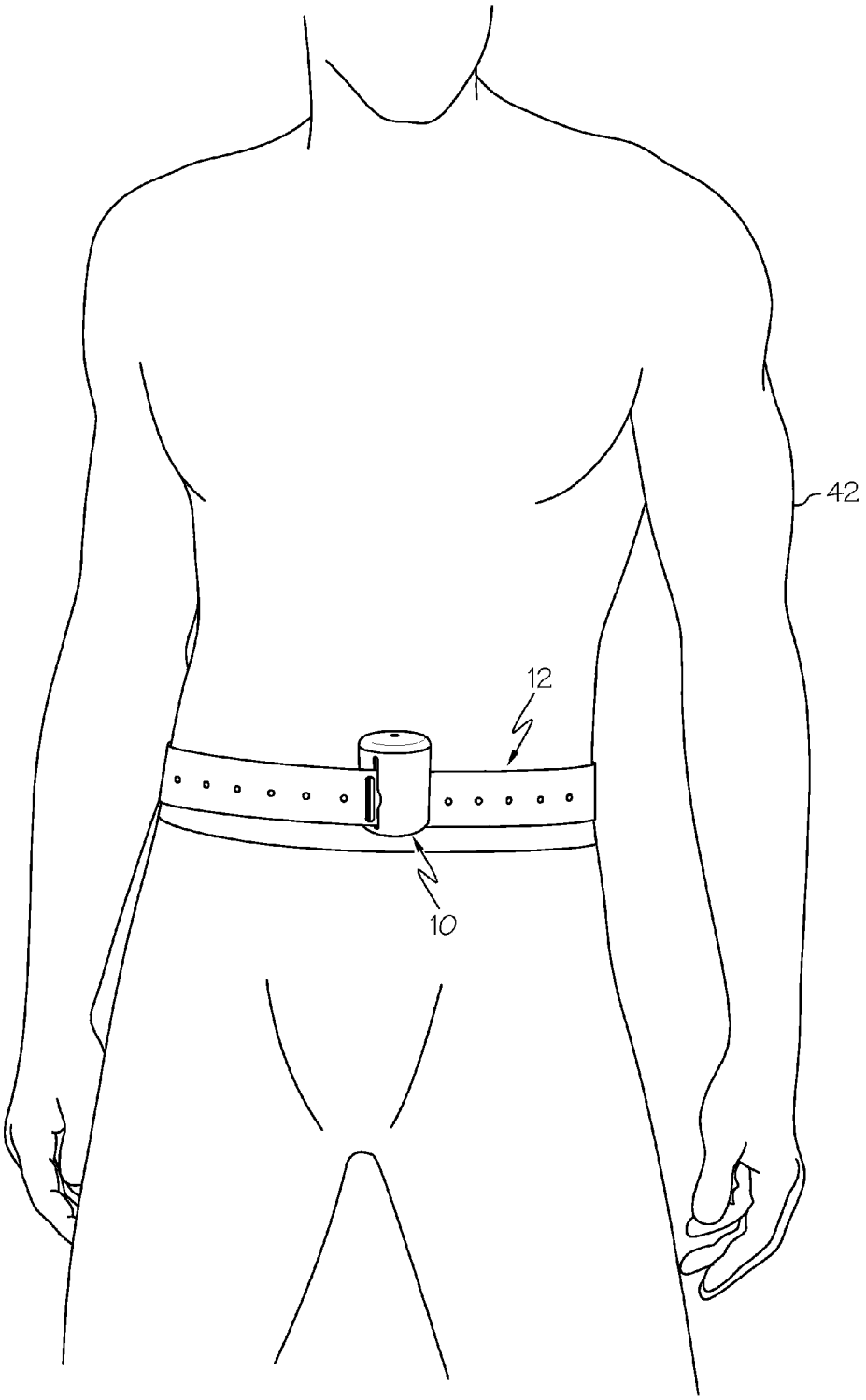
FIG. 5 is a view depicting the belt loop of FIG. 4 secured around a patient with the casing placed centrally of the patient's abdomen.

As shown, the belt 12 is retracted within a casing 20 which may be quite open to decrease weight. The casing 20 may have a belt clip 22 so the overall device 10 can be clipped to a belt or it may just be placed in a pocket. As shown in FIG. 2, the casing 20 includes a spool mechanism 30 to which attached end 16 of the belt 12 is attached. The casing 20 may be formed with a cap 24 for ease of construction. The spool mechanism 30 is operatively connected to a constant pressure spring 32 which functions to retract the belt 12 around the spool 30. The free end 14 of the belt 12 may pass through an opening 34 in casing 20. The free end 14 may be reinforced with metal or otherwise sized such that the free end 14 may not pass into the casing 20 through opening 34.

Figure 6:
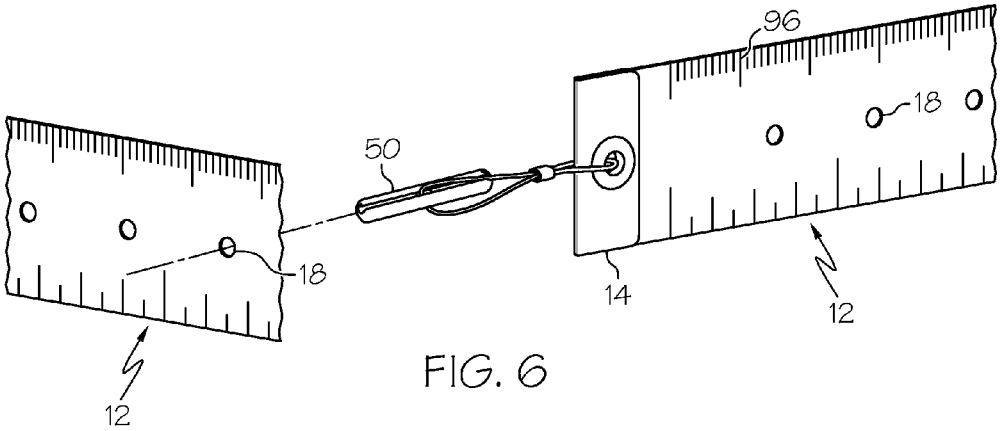
FIG. 6 is a perspective view showing a t-shaped connector bar being inserted through a belt opening.
Figure 7:
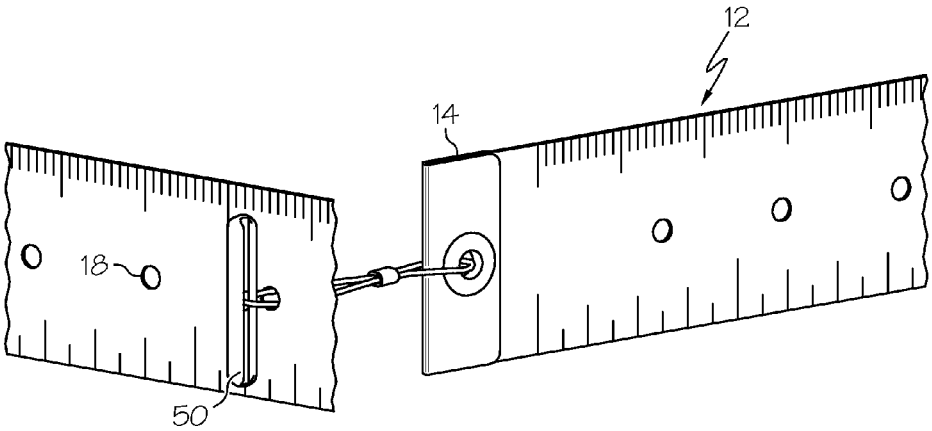
FIG. 7 is a view similar to FIG. 6 in which the T-shaped connector bar is tipped to a fixed position.
Figure 16:
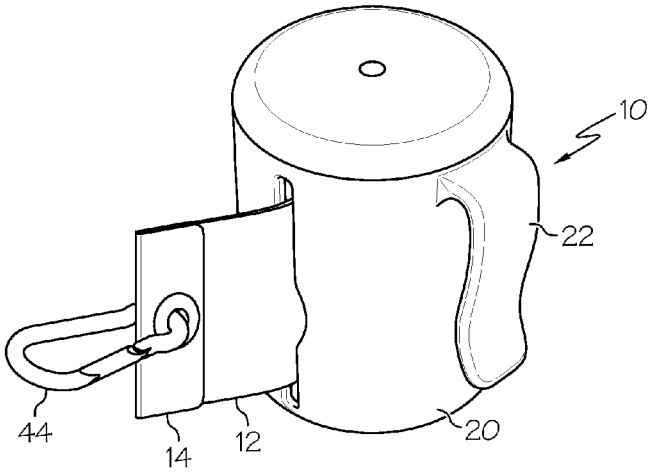
FIG. 16 shows a transfer belt apparatus with the belt retracted showing a carabiner clip on the belt free end.

In order to form a usable and secured belt loop 40 around a patient 42, a simple carabiner 44 attached to free end 14 as shown in FIG. 16 could be fitted through a single hole 18 or a pair of holes to create the desired sized loop about a patient. Alternatively, a connector bar 50 could be attached at the free end 14 and it could easily pass through a desired hole 18 and then rotate and expand out to lock it in place. FIGS. 1-7 show a t-bar connector 50 which may be attached to a short cable 52 attached to a grommet 54 or any other means of attaching it to the belt end. The t-bar connector 50 may be rotated to pass an end through a belt opening 18, and then positioned to lock as shown in FIGS. 6 and 7. The t-bar connector may be a simple bar or may involve a bar in which a pair of connector bars may extend outwardly on an end pivot to form a locked t-connection.

Another approach to lock the belt 12 into a loop 40 of a desired diameter would be to put a friction locking element on the belt such as a conventional airline seatbelt clip that could make a friction lock at any position along the belt 12. With a simple friction lock system no belt holes would be required.

In some forms, the belt free end 14 could be looped back and fixed to the casing 20 itself. In such forms, the belt 12 would need to be fixed such that it could not extend out further from spool 30 since the purpose of the belt is to provide a safety point about the patient which a nurse or care provider may hold onto to provide support, balance assistance and to prevent injury if the patient collapses. Some forms shown therefore portray ways to lock the free end 14 to the casing 20 and how to lock the belt 12 to the casing 20 to prevent further retraction or extension.

Figure 8:
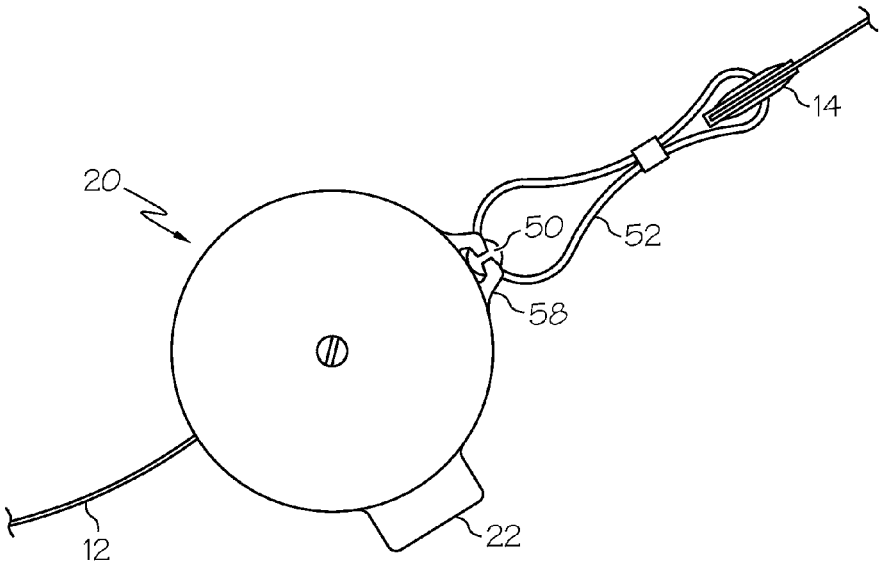
FIG. 8 is a top view of a retractable transfer belt in which the free end of the belt is attached to the casing.
Figure 9:
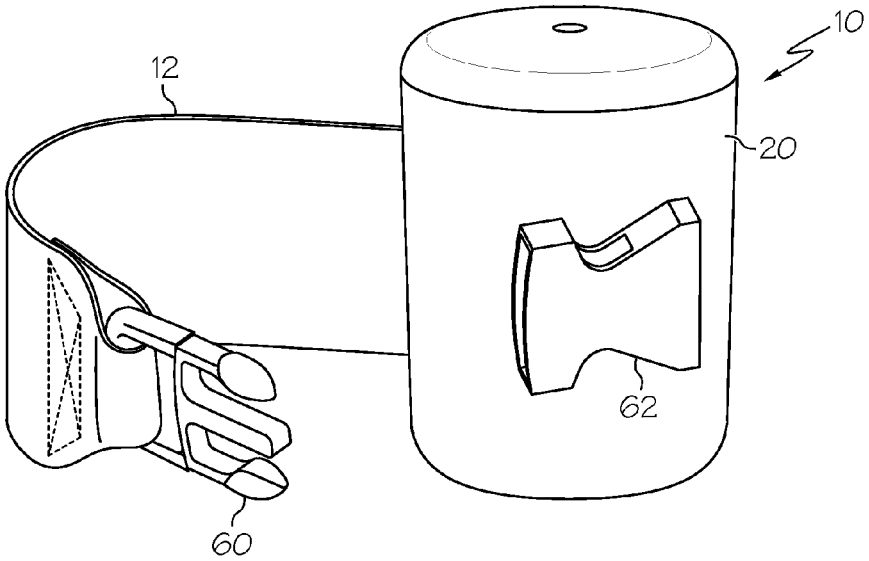
FIG. 9 is a perspective view showing a transfer belt in which the belt free end connects to the casing via a squeeze buckle.
Figure 10:
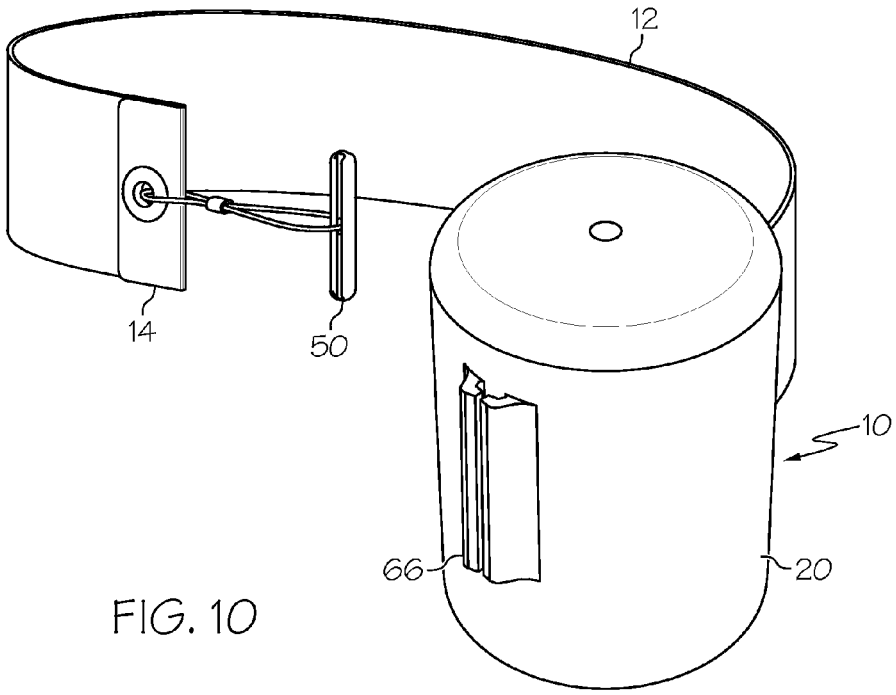
FIG. 10 is a perspective view showing a transfer belt with a T-bar free end that can be secured to the casing.
Figure 11:
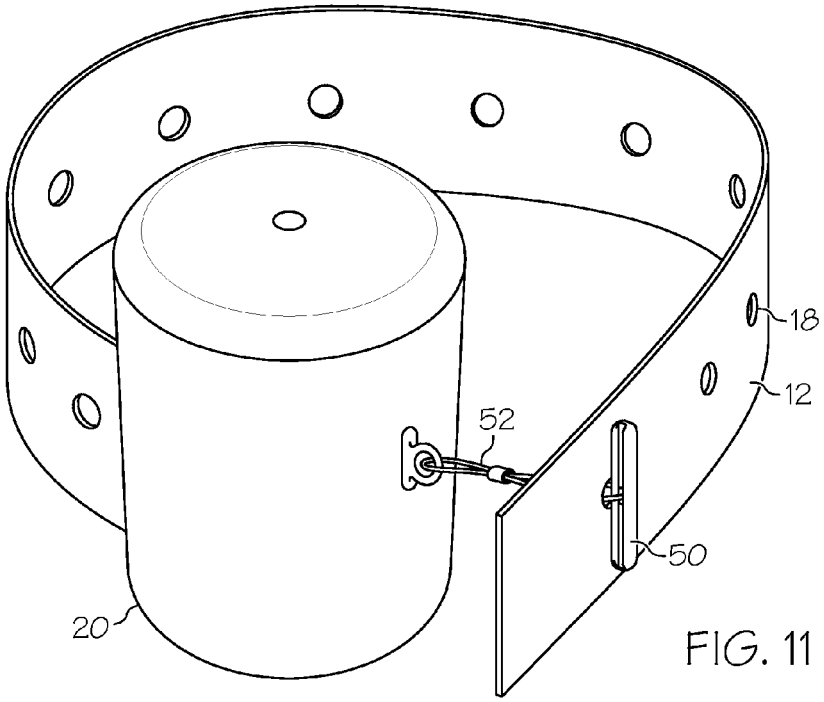
FIG. 11 is a perspective view showing a transfer belt where a T-bar is fixed to the casing and is secured to the belt.
Figure 12A:
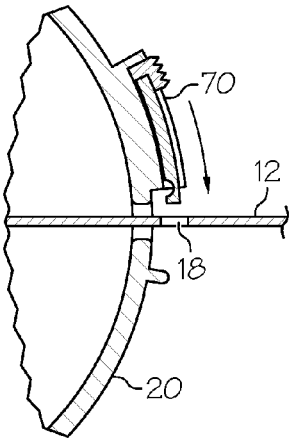
FIG. 12A is a cross-sectional view of a locking mechanism to lock the belt to the case.
Figure 12B:
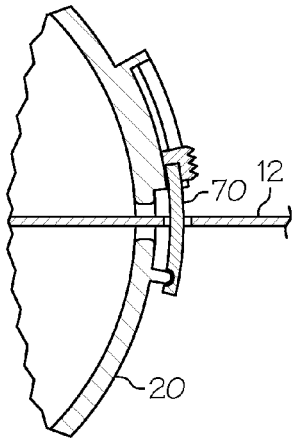
FIG. 12B is a cross-sectional view similar to FIG. 12A in which the belt is locked.
Figure 13A:
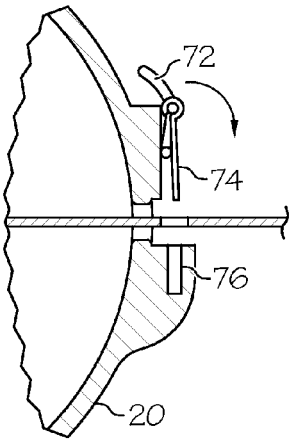
FIG. 13A is a cross-sectional view of an alternative lock mechanism.
Figure 13B:
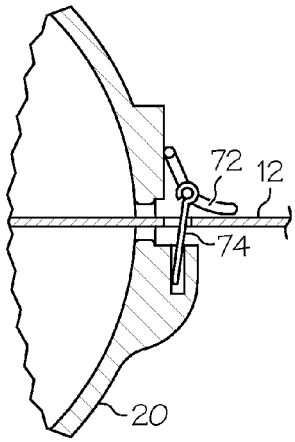
FIG. 13B shows the lock mechanism of FIG. 13A in which the belt is locked.
Figure 14A:
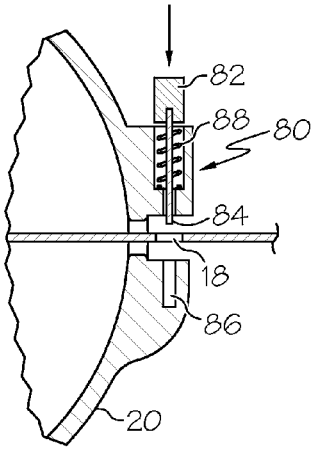
FIG. 14A is a cross-sectional view of another alternative lock mechanism.
Figure 14B:
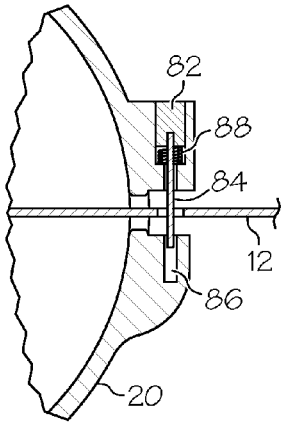
FIG. 14B shows the lock mechanism of FIG. 14A in which the belt is locked.
Figure 15A:
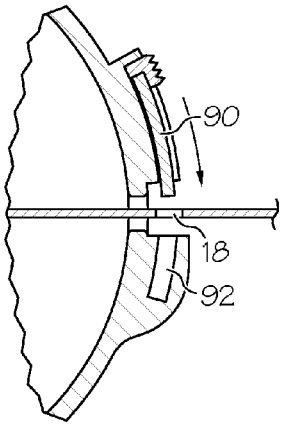
FIG. 15A is a cross-sectional view of yet another alternative lock mechanism.
Figure 15B:
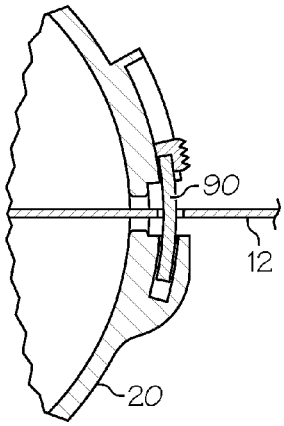

FIG. 8 shows a form in which the belt 12 would extend out from casing 20 and the free end 14 is shown attached to a lock member 58. FIG. 9 shows an alternate construction in which free end 14 includes a male belt buckle 60 which may be snapped into a mating female belt buckle 62. FIG. 10 shows a form in which t-bar connector 50 may be captured and locked into a slide lock 66. In the embodiment of FIG. 11, the t-bar connector 50 is attached directly to casing 20 and the t-bar connector 50 is simply secured through the desired belt opening 18.

FIGS. 12-15 show some of the ways to lock the extended belt 12 from further extension or retraction in forms in which the free end 14 is secured directly to casing 20. In FIGS. 12A and 12B, a slide member 70 is constructed and arranged on casing 20 such that it may pass through a belt opening 18 to lock the belt 12 as shown. FIGS. 13A and 13B show an alternate design in which a latch 72 may be lifted causing an attached member 74 to slide through belt opening 18 and lock into a receiving opening 76. FIGS. 14A and 14B show a form in which a lock is achieved with a vertically spring loaded "click-pen" type of connection 80. As button 82 is depressed, a pin 84 is urged through a belt opening 18 into a receiving opening 86. A second depression of button 82 may be designed to cause the pin 84 to retract due to spring 88. FIGS. 15A and 15B show a lock similar to FIG. 12 in which a slide member 90 may slide through a belt opening 18 and be received in a recess 92. This lock would be similar to the locking mechanisms found in many utility knives.

Another responsibility for nurses and other care providers is to measure the length, width, depth or elevation of a patient's wound, incision, and bruise or else measure the circumference of their waist or extremities. These measurements are taken and documented in the patient's chart and the like to record the progress or decline of a patient's incision, bruise etc. Also, some patients are unable to stand up and therefore their height is measured while they lay in bed and the care provider uses a tape measure or could use the spaced indicia markers located along the transfer belt 12 to measure the patient's height. To assist the care provider in measuring these things, one or both sides of the belt may include spaced indicia markers 96, such as an English and/or metric ruler along the length of the belt 12. The markings 96 could be applied in any suitable matter, such as stitching, fabric paint and the like.

As shown in the figures, it is possible to form the belt 12 so it could be removable for cleaning. There are several ways in which this could be accomplished.

Figure 17:
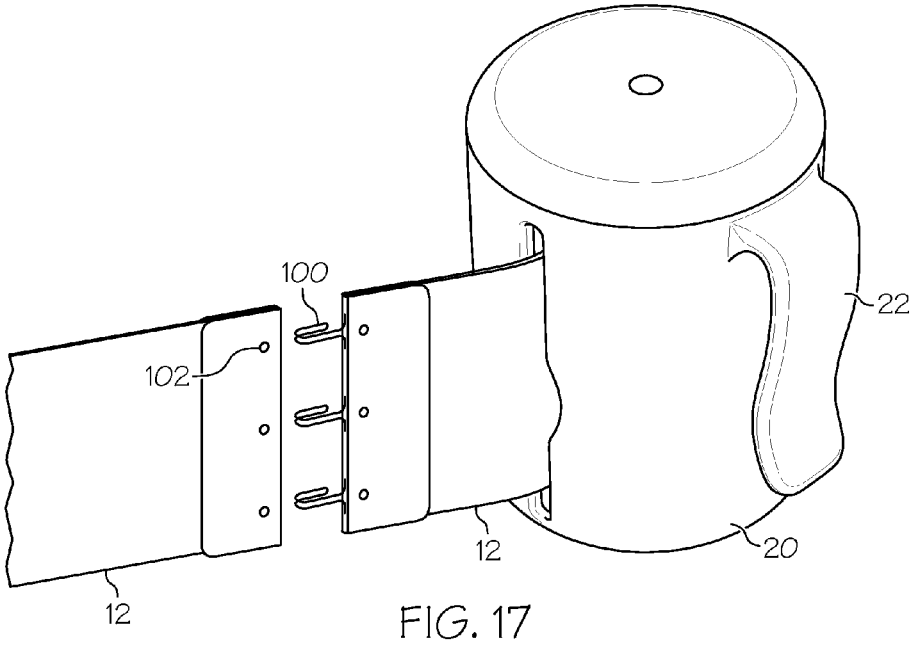
FIG. 17 shows a belt in which the belt can be largely removed.

FIG. 17 shows a form in which there are a plurality of hooks 100 sewn or attached to the middle section of the first end of the belt 12. A plurality of mating eyes 102 sewn or attached to the middle section of the second end. The hooks 100 connect with the eyes 102 and stay together to comprise one belt. When someone wants to wash or detach the belt, the hooks 100 and eyes 102 could be separated to remove most of the belt length. This would also allow the removed belt section to be replaced with a replacement section. The detached section could be used as a transfer belt while detached and reattached when desired.

Figure 18:
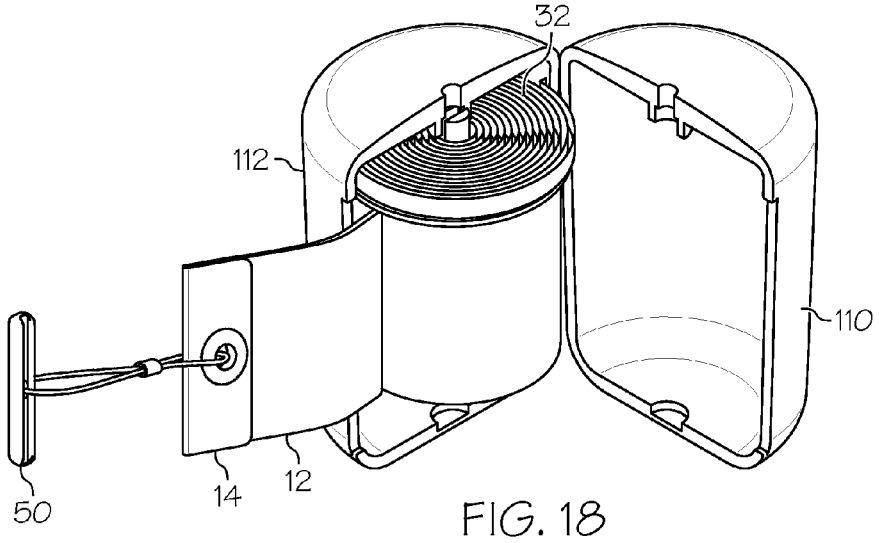
FIG. 18 shows a transfer belt apparatus wherein the case can open to replace or clean the belt and spool.
Figure 19:
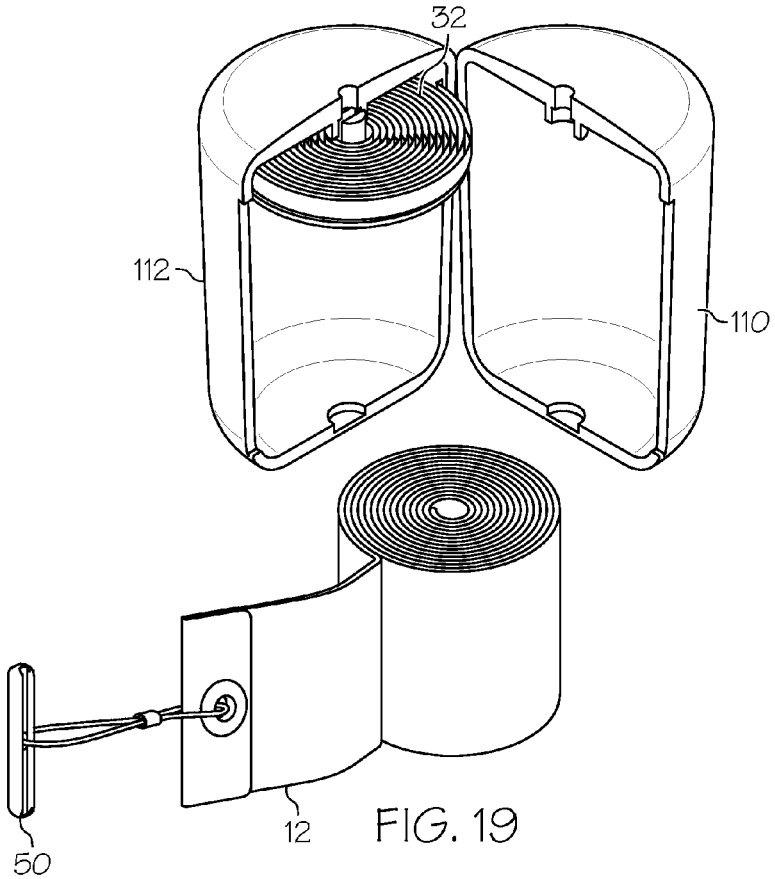
FIG. 19 shows the transfer belt apparatus of FIG. 18 with the belt and spool removed.

FIGS. 18 and 19 show a transfer belt apparatus 10 in which the casing 20 may be opened and is shown with two mating clamshell sections 110, 112. once opened, the spool 30 with belt 12 may be removed for cleaning or replacement. This would allow removal of the belt for cleaning, or the use of disposable transfer belts within the spool 30.

In any form in which the belt 12 is fixed to the casing 20, the casing 20 will need to be strong enough to support the expected load of an attached patient. In forms in which the belt 12 is secured back upon itself, the casing 20 may be quite light since it would be subjected to far fewer stresses. The belt 12 may be made from any suitable materials that are used for weight transfer belts including materials used in car safety belts. The thickness and width of the belt 12 may be adjusted as desired in designing the transfer belt apparatus 10 of the invention.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A retractable transfer belt comprising:

an elongated belt having a free end and a fixed end;

a spool about which said belt is wound with said fixed end being secured to said spool;

a casing in which said spool is held such that the spool may rotate, said casing further including an opening through which said belt exits the casing;

a spring mechanism inside said casing coupled to said spool to cause said belt to be retracted into said casing onto said spool; and a loop securing mechanism for securing an extended belt into a loop, wherein said loop securing mechanism includes a plurality of belt openings and said free end of said belt includes a member that may pass through and be secured to a belt opening.

2. A transfer belt apparatus comprising:

an elongated belt having a free end and a fixed end, said fixed end being securable to a spool inside a casing, said casing further including a spring mechanism which is coupled to said spool for retracting said belt about said spool, the free end of said belt including a mechanism for securing the belt into a loop of a selected size, wherein said belt includes a plurality of spaced openings and said free end of said belt securing mechanism includes a device for passing through one of said spaced openings to form a securely closed loop.

3. The transfer belt apparatus of claim 2 wherein said belt free end includes a t-bar connector which may be threaded through a belt opening to provide a secured loop.

4. The transfer belt apparatus of claim 3 characterized in that said casing includes a clip for securing said apparatus to a belt or other clothing item for storage when not being used.

* * * * *